United States Patent [19]

Steen

[11] Patent Number: 4,963,228

[45] Date of Patent: Oct. 16, 1990

[54] HEADBOX HAVING COANDA NOZZLE FOR MIXING SLURRY THEREIN

[75] Inventor: Conrad Steen, Mobile, Ala.

[73] Assignee: J. M. Voith GmbH, Heidenheim, Fed. Rep. of Germany

[21] Appl. No.: 428,351

[22] Filed: Oct. 27, 1989

[51] Int. Cl.[5] ..... D21F 1/02

[52] U.S. Cl. ..... 162/344; 162/336

[58] Field of Search ..... 162/216, 336, 337, 344

[56] References Cited

U.S. PATENT DOCUMENTS

| | | | |
|---|---|---|---|
| Re. 28,269 | 12/1974 | Hill et al. | 162/344 |
| 2,052,869 | 9/1936 | Coanda | 239/418 |
| 2,203,802 | 6/1940 | Theler | 162/344 |
| 3,853,695 | 12/1974 | Back et al. | 162/216 |

*Primary Examiner*—Karen M. Hastings

*Attorney, Agent, or Firm*—Jeffers, Hoffman & Niewyk

[57] ABSTRACT

A headbox for a paper making arrangement involves the use of internal Coanda type nozzles within the headbox for recirculation and agitation of slurry therein. The Coanda nozzle has an inlet, an outlet, and a primary flow slit adjacent a curved surface which recedes from the flow axis of the primary flow slit. The primary flow is recycled water which has drained from the slurry on the web-forming surface and which is delivered under pressure to the Coanda nozzle. This causes slurry in the headbox to be entrained and drawn into the inlet of the Coanda nozzle, from which it is thrust out through the outlet of the Coanda nozzle back into the headbox. The Coanda nozzle inlet is aligned with but spaced from a slurry supply nozzle in the headbox such that a portion of the entrained slurry comes from the supply nozzle and another portion comes from slurry already in the headbox.

13 Claims, 3 Drawing Sheets

HEADBOX HAVING COANDA NOZZLE FOR MIXING SLURRY THEREIN

BACKGROUND OF THE INVENTION

The present invention relates generally to headboxes used for distributing a paper pulp slurry onto a moving web in connection with a paper making process, and more particularly to an improved headbox having better slurry handling characteristics.

Older type headboxes which are either open to atmospheric pressure or which have a pressurized air cap utilize rotating perforated cylinders to stir and disperse pulp slurry within the headbox. These devices have several shortcomings, including relatively poor agitation and pulp dispersion, and buildup of pulp around the edges of the perforations. Furthermore, sometimes the perforations impart a memory on slurry flows, wherein ridges or streaks are formed in the outgoing slurry flow.

In modern hydraulic headboxes, slurry passes through a section having many channels wherein the cross-section of each channel varies along the direction of flow. The passages and channels of the headbox must be carefully designed and sized to generate a particular flow velocity and to generate microturbulence. The generation of microturbulence is necessary as this is the mechanism which prevents floc formation in the slurry. These headboxes, if not carefully sized or manufactured, can cause fiber roping and buildup at passage inlets and may fail to generate sufficient turbulence for pulp dispersion. They also can be quite sensitive to flow pulsations in the slurry delivery system.

It would be desireable to provide an improved headbox arrangement which provides for efficient agitation and dispersion of paper slurry in the headbox while avoiding the limitations of the prior art.

The present invention involves the use of efficient fluid dynamical stirring and dispersing means in a headbox instead of rotating perforated cylinders or a multitude of flow channels.

The fluid dynamical means set forth herein is in the form of Coanda nozzles placed in the headbox upstream of the slice. Coanda nozzles produce high shear, mixing, recirculation, and dilution. The "Coanda effect" which these nozzles create is exemplified by U.S. Pat. No. 2,052,869, issued to Henri Coanda. Briefly, this phenomenon can be described as the tendency of a fluid, which emerges from a slit under pressure, to attach itself or cling to and follow a surface in the form of an extended lip of the slit, which recedes from the flow axis of the fluid as it emerges from the slit. This creates a zone of reduced pressure in the area of the slit so that any entrainable material which is in the zone will become entrained and flow with the fluid which has attached itself to the extended lip.

U.S. Pat. No. 3,853,695 also describes the use of the Coanda effect as applied to headbox nozzles. There the Coanda nozzle is used immediately before the discharge slice to supply to the slurry "all the energy" needed to accelerate the slurry flow through the discharge slice at a particular discharge velocity onto the web-forming surface. In the currently proposed scheme, however, the Coanda nozzles are used only for slurry mixing; hence, energy requirements are greatly reduced.

SUMMARY OF THE INVENTION

The present invention involves, according to one aspect thereof, a headbox used in connection with a paper making arrangement and having a discharge gap for discharging paper pulp slurry onto a web-forming surface. The improvement in combination therewith includes a slurry nozzle communicating under pressure a source of paper pulp slurry with the headbox at a certain rate, and a Coanda nozzle disposed within the headbox and having a slurry inlet, a slurry outlet, and a primary flow slit in communication with the slurry inlet and slurry outlet, the slurry inlet being aligned in flow direction with the slurry nozzle while being spaced therefrom. The Coanda nozzle has a Coanda effect surface therein adjacent the primary flow slit and being a curved surface initially substantially parallel to a flow axis of the primary flow slit and deviating therefrom in a smooth curve toward the slurry outlet. Means are provided for communicating a primary flow fluid under pressure to the primary flow slit such that primary fluid exits from the primary flow slit into the Coanda nozzle and entrains a secondary flow of slurry from the slurry nozzle through the Coanda nozzle from the slurry inlet to the slurry outlet, and also entrains a recirculation flow of slurry from the outlet of the Coanda nozzle through the headbox and into the inlet of the Coanda nozzle.

It is an object of the present invention to provide an improved headbox for a paper making arrangement having better slurry handling characteristics to minimize the development of non-uniformities in the slurry which is deposited on the web-forming surface.

Other objects and advantages of the present invention will be apparent from the following descriptions.

DESCRIPTION OF THE PREFERRED EMBODIMENT

Figure 1:
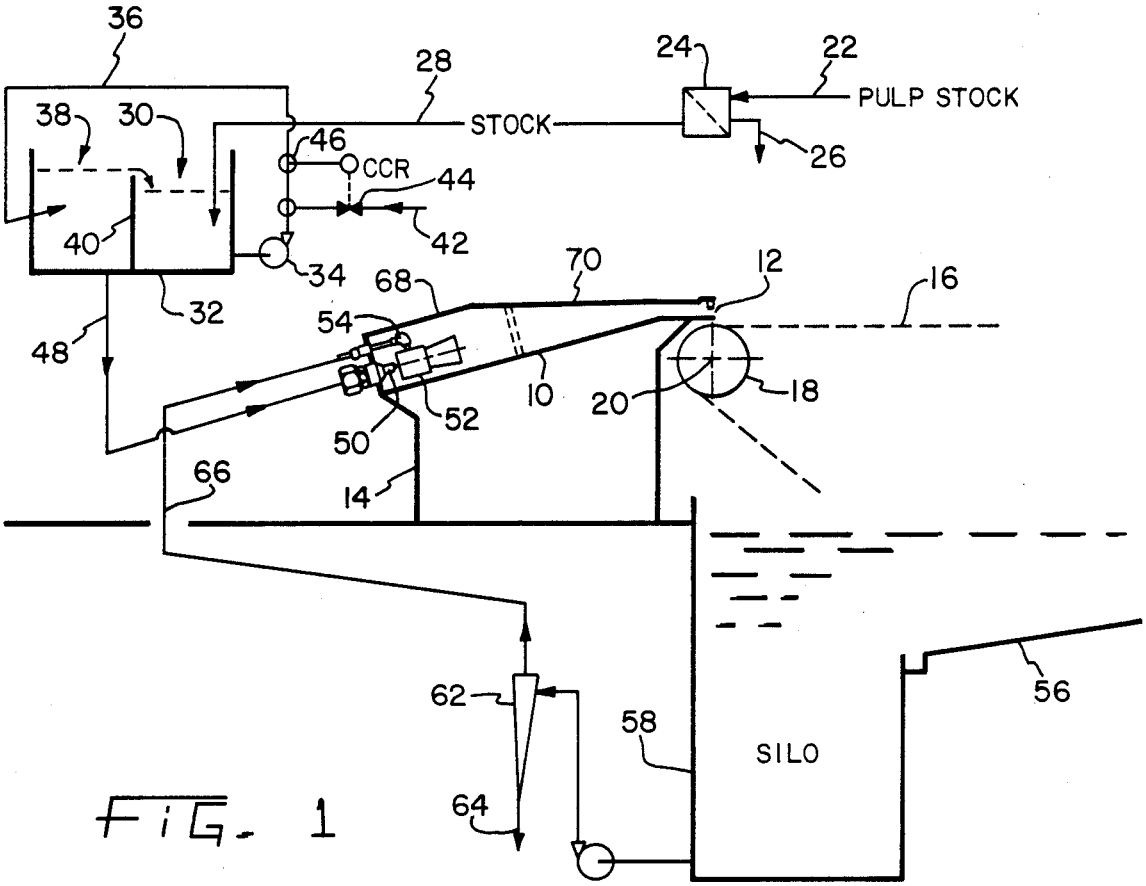
FIG. 1 is a schematic representation of a paper making arrangement particularly showing the headbox in cross-section and the web-forming surface and slurry delivery system.

Referring to FIG. 1, there is illustrated a paper making arrangement including a headbox 10 having a discharge gap 12 and being supported by a support 14. Adjacent discharge gap 12 is a horizontally oriented web-forming surface 16 which wraps about a rotatably mounted roll cylinder 18 having a horizontal axis of rotation 20 disposed vertically below discharge gap 12 and oriented in transverse machine direction. Web-forming surface 16 is in the form of a continuous wire belt which is supported and returned by additional rotatably mounted roll cylinders not illustrated. Paper pulp slurry under pressure within headbox 10 is discharged horizontally through discharge gap 12 onto wire 16 which is disposed just below the gap opening.

Pulp stock in the form of a liquid slurry is received through line 22 by a screening device 24 which screens out large particles and debris which are discharged through waste line 26. The acceptable portion of the slurry is passed through screening device 24 through line 28 and into a first compartment 30 of a recirculating tank 32. A recirculating pump 34 draws slurry from first compartment 30 and pumps it through line 36 to second compartment 38 of tank 32. A baffle 40 separates compartment 30 from compartment 38 such that as slurry accumulates in second compartment 38 it spills over baffle 40 in a weir-like manner into compartment 30. The constant recirculation within tank 32 caused by pump 34 keeps the fibers dispersed within the slurry and helps to prevent clumping and settling of the slurry. A water line 42 and valve 44 allow the introduction of diluting water. Valve 46 allows regulation of the amount of recirculation.

Slurry is drawn from compartment 38 of tank 32 through slurry feed pipe 48 and introduced into headbox 10 through feed nozzle 50. Disposed within headbox 10 is an internal type Coanda nozzle 52 aligned with but not directly connected with feed nozzle 50. A primary flow is introduced into Coanda nozzle 52 through primary feed pipe 54 which delivers water which has been recovered from the slurry introduced onto web-forming wire 16. The excess water which drains from wire 16 is caught by basin 56 disposed below the full length and width of wire 16 and is accumulated in a sump silo 58, from which it is pumped by a pump 60 to a cyclone separator 62. In separator 62, heavy impurities are removed by vortex action and are discharged through waste pipe 64. The acceptable portion of the water (also containing lost fibers from wire 16) is delivered under pressure through line 66 to primary feed pipe 54 to induce the Coanda effect in nozzle 52, as will be explained in greater detail below.

Figure 2:
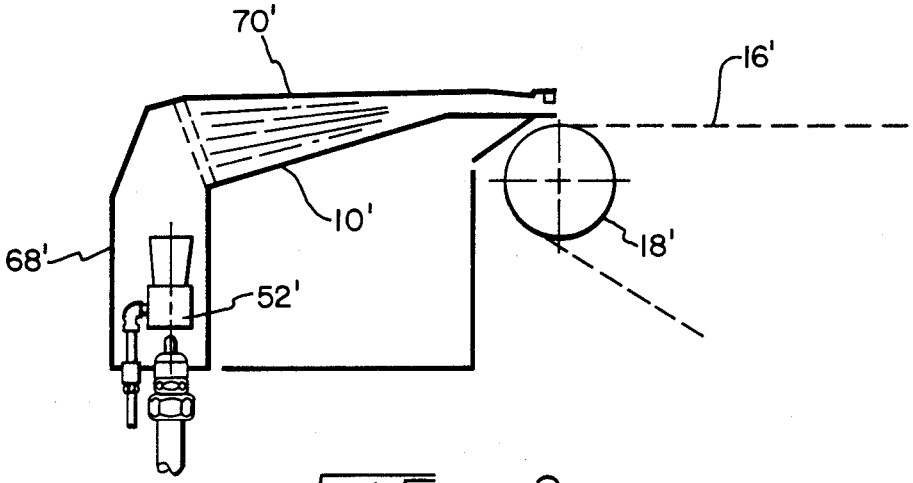
FIG. 2 is an alternative embodiment of the headbox of FIG. 1.

The headbox of FIG. 1 is of a predominantly horizontal configuration. A first portion 68 containing Coanda nozzle 52 is oriented at an angle of about 15° from horizontal and a second portion 70 including discharge gap 12 is oriented substantially horizontally. If desired, the headbox can be modified as shown in FIG. 2 so that the first portion is oriented vertically such that the slurry undergoes a 90° turn from the Coanda nozzle to the discharge gap. This latter configuration results in a headbox having a lesser overall horizontal length.

Figure 3:
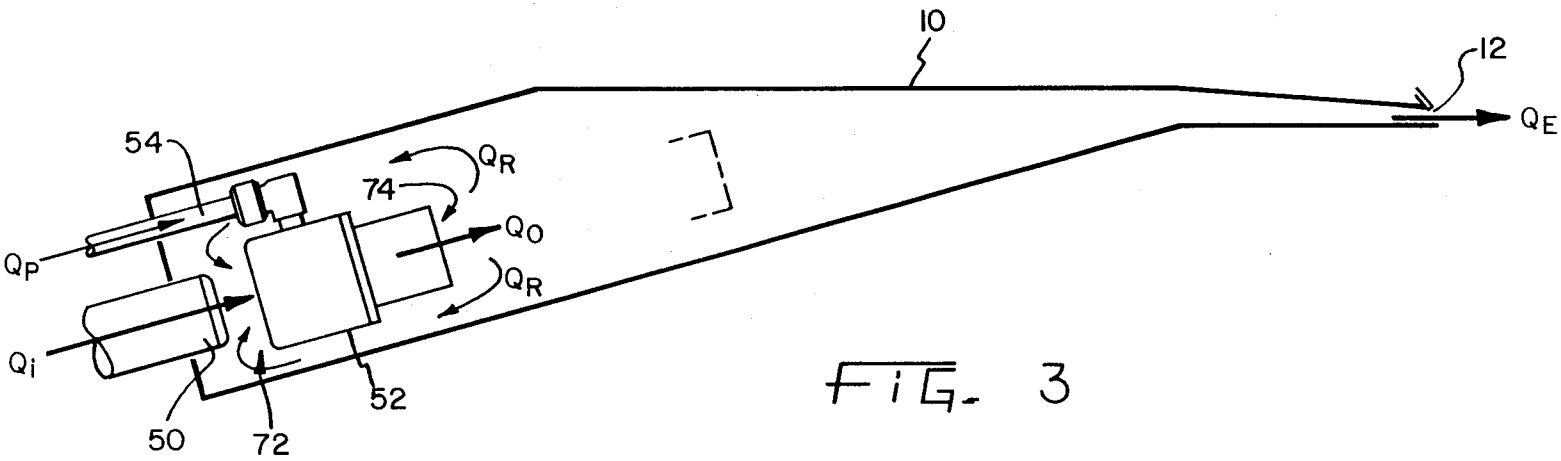
FIG. 3 is an enlarged view of the headbox of FIG. 1.

Referring to FIG. 3, headbox 10 is illustrated in greater detail. One row of internal type Coanda nozzles 52 is utilized. Internal type nozzles are preferred since they produce stronger shear and greater entrainment, hence recirculation, than other types of Coanda devices. Depending on headbox geometry, discharge gap width, flow discharge rate, and velocity, more rows of nozzles can be employed. Similarly, the nozzle size is also selected based on total flow requirements.

Upstream of each Coanda nozzle 52 is a slurry feed nozzle 50, terminated a small distance from the Coanda nozzle inlet 72. It is important to note that the slurry feed nozzle 50 and the Coanda nozzle 52 are not coupled. The Coanda nozzle 52 is sized in such a manner that its entrainment or pumping capacity exceeds the flow rate supplied by the slurry feed nozzle 50. Thus, Coanda nozzle 52 entrains some of the surrounding slurry in headbox 10 and keeps the entire stock in the headbox agitated and dispersed.

Coanda nozzles, when operated against back pressure, become inefficient; that is, their entraining capabilities are severely reduced. In the arrangement described herein, the pressure in headbox 10 is controlled by the flow of pulp slurry supplied through line 48. The pressure in headbox 10 is higher than ambient to produce the desired discharge velocity through gap 12. The pressure is generated by the hydraulic head of the slurry in tank 32 (see FIG. 1), but can also be generated by a pump in supply line 48, if desired. As far as Coanda nozzle 52 is concerned, the pressure of the surrounding slurry at its inlet 72 is essentially the same as at its exit 74. There is virtually no pressure differential in the slurry external to Coanda nozzle 52 within headbox 10; hence, back pressure is virtually nonexistent, and Coanda nozzle 52 can operate at its maximum efficiency.

The arrows in FIG. 3 indicate various flow components of the slurry within headbox !0, as follows:

Qp = Primary flow supplied to nozzle 52;

Qi = Incoming slurry flow supplied through nozzle 50;

Qr = Recirculation flow component;

Qo = Flow leaving nozzle 52 (Qo = Qp + Qi + Qr); and

Qe = Flow from discharge gap (Qe = Qi + Qp);

Assuming a nozzle entrainment ratio of 8, which is an average entrainment ratio of internal Coanda nozzles with short diffusers, the percentages of the various flow components is approximately as follows:

Qe = Defined as 100%

Qp = 18%

Qi = 82%

Qr = 47%

Qo = 147%

The ratios of Qp, Qi and Qr can be varied simply by changing the primary flow rate and the incoming slurry flow rate. The primary flow rate can be changed by changing the slit width of the Coanda nozzle (described further below) and/or by changing the supply pressure of the primary fluid.

Figure 4:
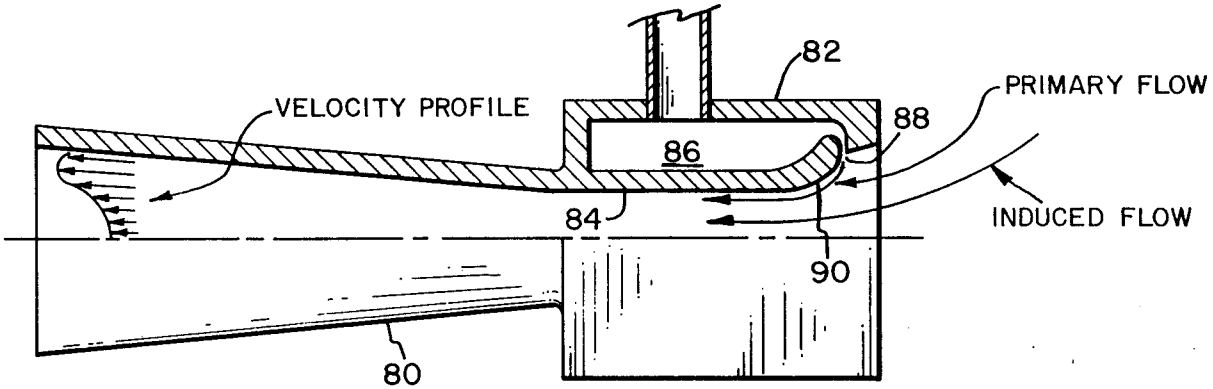
FIG. 4 is an idealized cross-sectional view of a typical Coanda type nozzle useful in understanding the Coanda effect.
Figure 5:
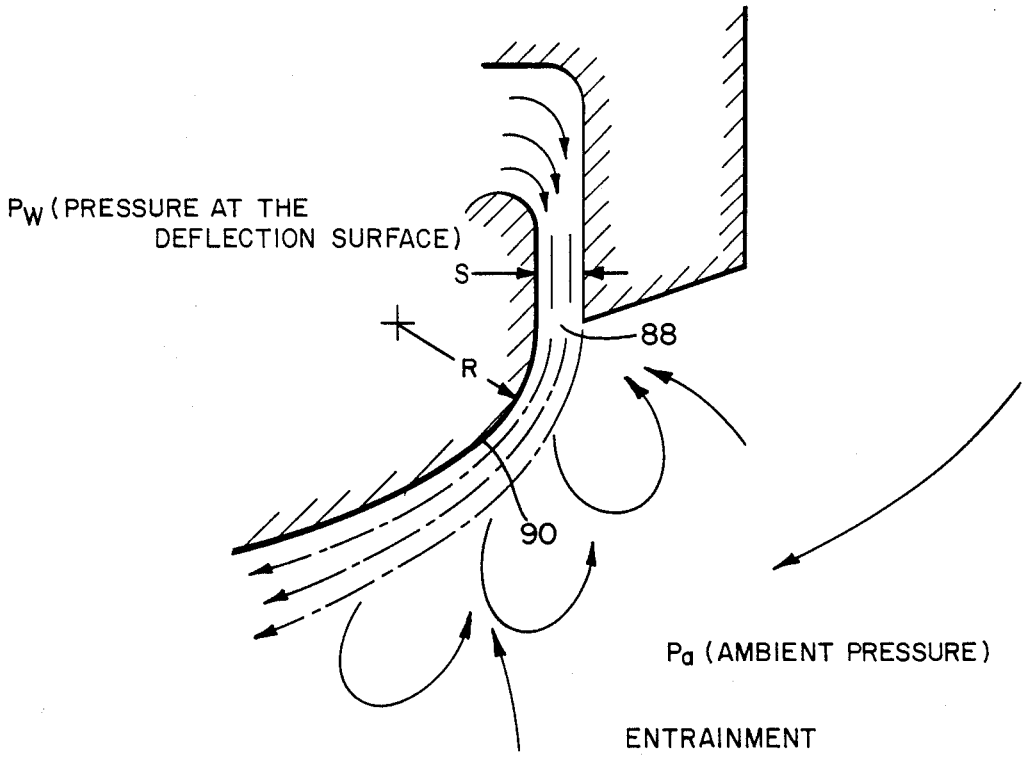
FIG. 5 is an enlarged fragmentary view of a portion of the nozzle of FIG. 4.

Referring to FIGS. 4 and 5, the Coanda effect is illustrated with respect to an idealized typical internal Coanda nozzle 80. A collar 82 surrounding a nozzle portion 84 defines an annular primary chamber 86 which is closed at the front and is open at the rear through an annular slit 88. A deflection surface 90 comprises an extension of one of the lips forming slit 88 and recedes from an orientation parallel to the axis of the slit 88 toward an orientation parallel to the axis of the nozzle 80. A primary flow of fluid is introduced into chamber 86 under pressure through conduit 92. The primary flow exits as a jet through slit 88 and attaches to and follows deflection surface 90, creating a pressure drop across the jet which induces a flow of surrounding fluid through nozzle 80.

The pressure differential $\Delta P$ between the pressure $P_w$ at the deflection surface 90 and ambient pressure $P_a$ is manifested according to the following formula:

$$\Delta P = P_a - P_w = K\rho_R{}^S V^2$$

Where:

K = constant

S = jet width

V = fluid velocity

R = radius of curvature $\rho$ = density

Consequently, from the above formula it can be observed that increasing the width of the jet increases the pressure differential and hence increases entrainment, and increasing the pressure of the primary fluid (thereby increasing its velocity through slit 88) will increase the pressure differential in proportion to the square of the velocity increase.

Figure 6:
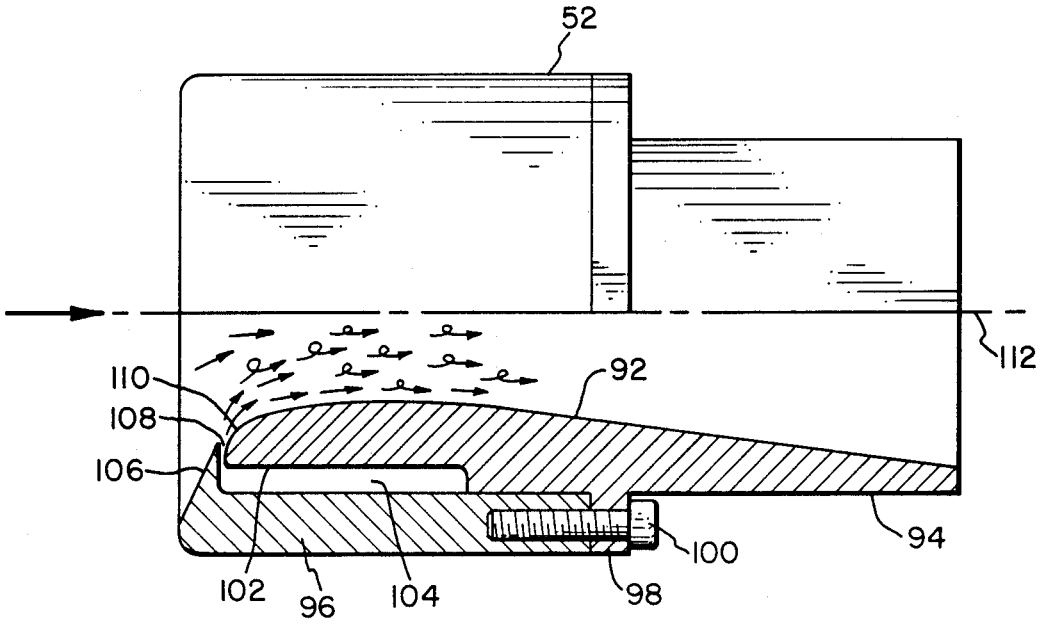
FIG. 6 is a cross-sectional view of a Coanda nozzle of the headbox of FIG. 1.

Referring in particular to FIG. 6, Coanda nozzle 52 is shown enlarged and in cross-section to illustrate the interior arrangement. Nozzle 52 includes a throat portion 92 having a relatively short diffuser 94. Throat portion 92 is surrounded by annular collar 96 which is attached to an annular flange 98 on throat 92 by several threaded bolts 100 received in corresponding threaded holes in flange 98. An annular recess 102 on the outer surface of throat portion 92 is overlain by collar 96, defining an annular chamber 104 therebetween. Primary feed pipe 54 communicates with chamber 104. An annular, radially inwardly protruding lip 106 on collar 96 forms an annular slit 108 between itself and the annular end 110 of throat portion 92. End 110 comprises a curved surface, initially perpendicular to axis 112 of nozzle 52, which recedes in a smooth curve toward an orientation parallel to axis 112.

Threaded bolts 100 provide for adjustment of the axial position of collar 96 with respect to throat 92, thereby permitting the width of slit 108 to be adjusted.

Alternate arrangements of the system of FIG. 1 can involve each supply line 48 and 66 being provided with a flow rate adjustment device, namely a valve, to control the distribution of slurry in the transverse machine direction. Similarly, heavy or light streaks in the web can be controlled by either increasing or decreasing the primary flow rate.

Since Coanda nozzles are powerful mixing and dispersing devices, additives can be injected in the headbox near the nozzle inlet or, if soluble in water, into the primary flow. Also, since the Coanda nozzles control flow conditions in the headbox via strong recirculation, its sensitivity to pulp supply line pulsations is greatly minimized.

The Coanda nozzles can either be internal, external or linear. They can be operated with water as a primary flow fluid, or if desired to preheat the slurry, with low pressure steam. In both cases they can be used either in open or closed headbox configurations.

While the present invention has been particularly described in the context of a preferred embodiment, it will be understood that the invention is not limited thereby. Therefore, it is intended that the scope of the invention include any variations, uses or adaptations of the invention following the general principles thereof and including such departures from the disclosed embodiment as come within known or customary practice in the art to which the invention pertains and which fall within the appended claims or the equivalents thereof.

What is claimed is:

1. In combination with a headbox used in connection with a paper making arrangement and having a discharge gap for discharging paper pulp slurry onto a web-forming surface, the improvement comprising:

a slurry nozzle communicating under pressure a source of paper pulp slurry with said headbox at a certain rate;

a Coanda nozzle disposed within said headbox and having a slurry inlet, a slurry outlet, and a primary flow slit in communication with the slurry inlet and slurry outlet, the slurry inlet being aligned in flow direction with said slurry nozzle while being spaced therefrom said Coanda nozzle having a Coanda effect surface therein adjacent the primary flow slit and being a curved surface initially substantially parallel to a flow axis of the primary flow slit and deviating therefrom in a smooth curve toward the slurry outlet; and means for communicating a primary flow fluid under pressure to said primary flow slit structured and arranged such that primary fluid exits from the primary flow slit into said Coanda nozzle and entrains a secondary flow of slurry from said slurry nozzle through said Coanda nozzle from the slurry inlet to the slurry outlet, and structured and arranged such that the primary fluid also entrains a recirculation flow of slurry from the outlet of the Coanda nozzle through said headbox and into the inlet of the Coanda nozzle.

2. The headbox of claim 1, in which the slurry nozzle and the Coanda nozzle are sized relative to each other such that the Coanda nozzle has a capacity to entrain flow therethrough at a rate in excess of the rate at which slurry is communicated to said headbox by said slurry nozzle, whereby the recirculation flow within the headbox is assured.

3. The headbox of claim 1, wherein the headbox is structured and arranged to operate under pressure in excess of ambient pressure, the excess pressure being generated by flow of slurry into said headbox from said slurry nozzle.

4. The headbox of claim 2, wherein the headbox is structured and arranged to operate under pressure in excess of ambient pressure, the excess pressure being generated by flow of slurry into said headbox from said slurry nozzle.

5. The headbox of claim 1, in which said means for communicating a primary flow fluid is in communication with means for excess water drained from the slurry on the web-forming surface and is structured and arranged to use said excess water as the primary flow fluid.

6. The headbox of claim 4, in which said means for communicating a primary flow fluid is in communication with means for excess water drained from the slurry on the web-forming surface and is structured and arranged to use said excess water as the primary flow fluid.

7. The headbox of claim 5, further including a vortex cyclone device and pump means for pumping the excess water through said vortex cyclone device for separation of heavy impurities therefrom prior to being communicated to the primary flow slit.

8. The headbox of claim 1, and further including recirculating tank means for holding and recirculating a supply of paper pulp slurry located upstream from said slurry nozzle and communicating therewith.

9. The headbox of claim 6, and further including recirculating tank means for holding and recirculating a supply of paper pulp slurry located upstream from said slurry nozzle and communicating therewith.

10. The headbox of claim 1, in which said headbox has a first portion including said Coanda nozzle oriented at an acute angle with respect to horizontal, and a second portion in communication with the first portion and including the discharge gap, the second portion being oriented substantially horizontal.

11. The headbox of claim 9, in which said headbox has a first portion including said Coanda nozzle oriented at an acute angle with respect to horizontal, and a second portion in communication with the first portion and including the discharge gap, the second portion being oriented substantially horizontal.

12. The headbox of claim 1, in which said headbox has a first portion including said Coanda nozzle oriented substantially vertical, and a second portion in communication with the first portion and including the discharge gap, the second portion being oriented substantially horizontal.

13. The headbox of claim 9, in which said headbox has a first portion including said Coanda nozzle oriented substantially vertical, and a second portion in communication with the first portion and including the discharge gap, the second portion being oriented substantially horizontal.

* * * * *